United States Patent [19]

Bellagamba

[11] Patent Number: 5,048,836

[45] Date of Patent: Sep. 17, 1991

[54] ATHLETIC SWING PRACTICE APPARATUS

[75] Inventor: Miro D. Bellagamba, Orlando, Fla.

[73] Assignee: International Sports Technology, Inc., Orlando, Fla.

[21] Appl. No.: 594,054

[22] Filed: Oct. 9, 1990

[51] Int. Cl.[5] ..... A63B 69/36; A63B 21/04

[52] U.S. Cl. ..... 273/183 B; 273/188 R; 272/136; 272/139; 272/143; 272/124

[58] Field of Search ..... 273/183 B, 188 R, 188 A, 273/190 R, 190 A, 190 B, 189 R, 189 A; 272/109, 134, 135, 136, 137, 138, 139, 142, 143, 124

[56] References Cited

U.S. PATENT DOCUMENTS

| | | | |
|---|---|---|---|
| 233,541 | 10/1880 | Oliver | 272/109 |
| 4,593,909 | 6/1986 | Anselmo et al. | 273/188 R |
| 4,852,881 | 8/1989 | Bellagamba et al. | 273/183 B |
| 4,993,705 | 2/1991 | Tolle | 273/142 X |

*Primary Examiner*—George J. Marlo

*Attorney, Agent, or Firm*—William M. Hobby, III

[57] ABSTRACT

An athletic swing practice apparatus has a lower back support belt which has flexible thigh straps which strap to a person's thighs and a flexible waist belt which attaches around a person's waist and a pair of flexible buttock support straps attached between the thigh straps and the hip belt. A pair of straps are attached to the lower back support belt and extend from the rear portion thereof around the front and each strap has a plurality of apertures for attaching a resilient cord thereto. Each resilient cord extends to a stationary member which can be a pole anchored in the earth which pole can have a plurality of apertures for attaching the resilient cord. A person can practice an athletic swing, such as a golf swing, while wearing the lower back support belt and having the straps attached with resilient cord to the stationary members to thereby apply a predetermined pressure to the person's lower torso during a practice swing and enhance the swing posture of the user.

9 Claims, 1 Drawing Sheet

ATHLETIC SWING PRACTICE APPARATUS

BACKGROUND OF THE INVENTION

The present invention relates to an athletic swing practice apparatus and especially to the combination of a lower back support belt and resilient swing supporting straps extending from predetermined positions on the support belt.

In the past, it has been common to provide a great variety of athletic swing practice systems including golf swing systems which include various types of straps for strapping the arms and portions of the body to force the body in a predetermined manner during a practice swing of a golf club. Other systems strap the wrist to force the wrist to maintain certain positions during a practice swing while yet other systems guide the golf club and sometimes provide for a belt having flexible waist support cords as shown in my prior U.S. Pat. No. to Bellagamba et al., 4,852,881. It has also been common in the past to provide various types of lower back supports, such as the lower back support belt taught in U.S. Pat. No. 4,709,692 for a thigh mounted lower back support belt by Kirschenberg. In the Kirschenberg patent a thigh mounted lower back support belt works to keep the human spine straight while a person is bending. The added support for the lower back aides the person engaged in aerobics, golf, lifting and prolonged sitting and provides full flexibility of motion while easing the support load of the lower back. The belt includes thigh straps attached to a waist belt which pulls the stomach back while bending. The present invention utilizes a thigh mounted lower back support belt, such as shown in the Kirschenberg patent, in combination with flexible straps attached at predetermined positions on the back of the belt and wrapping around the belt. The straps have resilient cords, such as bungee cords, attached thereto and extending to stationary upright poles, or the like, for providing a continuous pull on the straps from a predetermined position on the lower back support belt. This provides the advantage of lower back support while putting a continuous force on the golfer with extended resilient cords so that the waist is held during a golf swing in the proper position while the lower back is supported with the support belt to improve the athlete's swing and posture during the making of practice swings.

SUMMARY OF THE INVENTION

The present invention relates to an athletic swing practice system which includes a thigh mounted lower back support belt which fits onto a person to keep the human spine straight while bending. Thigh straps are attached to a waist belt with buttock support portions to pull the stomach back while bending. A pair of strap members are attached to the lower back support belt and have a pair of strap end portions extending from the lower back support belt. The strap portions are attached to the back of the waist belt and wrap around the front of the individual and/or held-in position by a front mounted metal ring so that one strap end extends in an opposite direction from the other. Each end portion of the straps has a plurality of apertures and each strap end portion has a resilient cord attached thereto and attached to a stationary member, such as a pole attached in the earth, so that a person can practice an athletic swing while wearing a thigh mounted lower back support belt having a constant pull from resilient cords pulling on straps in a predetermined direction to help obtain a proper swing of a golfer or the like. A pair of straps may be used and attached to the belt with VELCRO or hook and loop material attached to the rear portion of the lower back support belt. The straps can extend around the belt and through a metal ring attached on the front of the belt. A pair of plastic pipes can be anchored in the earth and may have a plurality of apertures therethrough for supporting a resilient bungee cord or the like to apply a predetermined force to the straps and lower back support belt.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
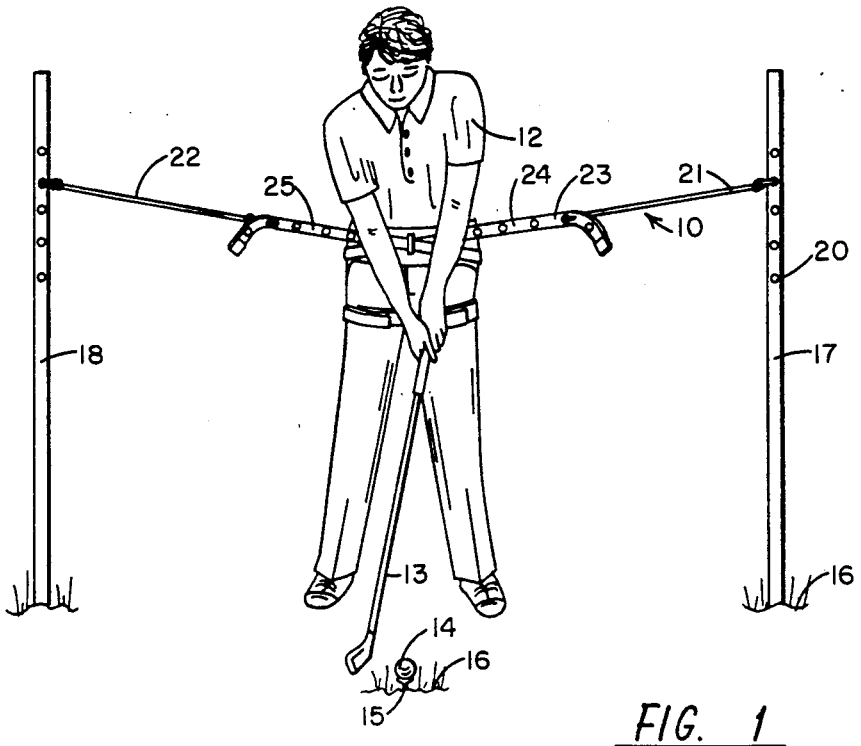
FIG. 1 is a front perspective view of an athletic swing practice apparatus in accordance with the present invention attached to a golfer during a practice swing.
Figure 2:
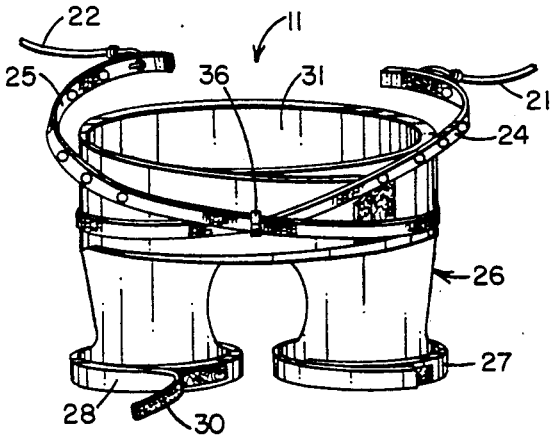
FIG. 2 is a front perspective view of the belt in accordance with FIG. 1.
Figure 3:
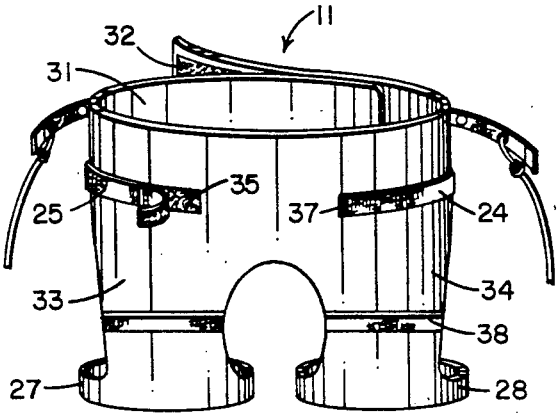
FIG. 3 is a rear perspective view of the athletic swing practice belt in accordance with the present invention.

Referring to the drawings, in FIGS. 1 through 3 an athletic swing practice apparatus 10, shown in FIG. 1, has a belt and strap portion 11 and has a golfer 12 mounted in the system in FIG. 1 holding a golf club 13 positioned for hitting a practice ball 14 sitting on a tee 15 on the earth 16. A pair of upright plastic pipes or poles 17 and 18 are driven in the earth 16 and each has a plurality of apertures 20 therethrough. A bungee cord or other resilient cord 21 is attached to the pole 17 while a bungee cord 22 is attached to the pole 18. The resilient cord 21 is attached to a strap 23 through one of the apertures 24 in the strap which may have grommets mounted through each aperture for support. The resilient cord 22 is attached to a strap 25, and each strap is attached to a lower back support belt 26 having a pair of thigh straps 27 and 28. Each set of thigh straps are attached to the thighs of a person using the belt with hook and loop attachments 30. Similarly, a waist belt portion 31 is supported with a VELCRO or hook and loop fastener 32 which wraps around a person's waist, as shown in FIG. 1. Thigh straps 27 and 28 are connected to the waist belt 31 with flexible buttock supporting members 33 extending between the thigh strap 27 and the waist belt 31 and a flexible buttock support member 34 attached between the thigh strap 28 and the waist belt 31.

This thigh mounted lower back support belt works to keep the human spine straight while a golfer is bending or making certain other motions by easing the support load of the lower back. The thigh straps attached to the waist belt pull the stomach back while bending. The strap member 25 is attached to the back of the waist belt 31 with a hook and loop attachment 35 and then extends around the front of the belt 31 where it passes through a metal ring 36 while the strap 24 is attached with a VELCRO attachment 37 on the back of the waist support belt 31 and extends around the front of the belt through the metal ring 36 so that the force applied by the stretched resilient cords 21 and 22 pulls around the golfer's waist to provide a continuous force on around the waist while a golfer is practicing. At the same time, the thigh mounted lower back support belt 26 provides continuous lower back support during the golfer's movement such that whenever the person's knees are bent or the person bends forward or any pulling on the buttock straps pulls down the back of the waist belt and pulls back on the overlapped front segments of the waist belt for restraining the forward curvature of the person's spine while forcing the person to maintain his position without undue twisting motion of the hips and lower spine. The present system forces a golfer 12 into better form, as shown in FIG. 1, with thigh straps 27 and 28 held to the buttock straps with VELCRO fasteners 38 to allow additional adjustments of the thigh mounted lower back support belt system.

It should be clear at this point that an athletic swing practice system has been provided which provides lower back support to a person practicing his golf swing whenever the golfer bends his waist or knees while providing a continuous applied force around the golfer's waist on both sides thereof to force the golfer to maintain his waist position and form during a practice swing. However, the present invention is not to be construed as limited to the forms shown which are to be considered illustrative rather than restrictive.

I claim:

1. An athletic swing practice apparatus comprising:

a lower back support belt having a pair of flexible thigh straps for strapping to a person's thighs and a flexible waist belt attachable around a person's waist and flexible buttock support strap means attached to each flexible thigh strap and to said flexible waist belt so that a person wearing the lower back support belt supports their lower back during predetermined movement of the body;

a pair of resilient cords;

strap means attached to said lower back support belt and having a pair of strap end portions extending from said lower back support belt and each strap end portion having adjustable attachment means thereon for attaching one of said resilient cords to each strap end portion; and a pair of stationary members adapted to be positioned a predetermined distance apart and having means for attaching one said resilient cord to each stationary member at one end portion of each resilient cord member whereby a person can practice an athletic swing while wearing said lower back support belt and having said straps attached with resilient cords to positioned stationary members and thereby apply a predetermined pressure to the person's lower torso during a practice swing.

2. An athletic swing practice apparatus in accordance with claim 1 in which said strap means includes two straps each attached to said lower back support belt and having an end portion.

3. An athletic swing practice apparatus in accordance with claim 2 in which each said strap has a first piece of material attached thereto for connection to a second piece of material attached to said lower back support belt, said pieces of material including interlocking hooks and loops which are detachably engageable with each other.

4. An athletic swing practice apparatus in accordance with claim 3 in which each said strap is attached to said lower back support belt in the back portion thereof and each strap extends around to the front of the flexible waist belt.

5. An athletic swing practice apparatus in accordance with claim 4 in which the flexible waist belt has a ring attached to the front thereof and each said strap passes through said ring.

6. An athletic swing practice apparatus in accordance with claim 5 in which each said strap adjustable attachment means includes a plurality of apertures for attaching one said resilient cord thereto.

7. An athletic swing practice apparatus in accordance with claim 6 in which said stationary members are poles attachable to the earth.

8. An athletic swing practice apparatus in accordance with claim 7 in which each said stationary member is a plastic pipe having a plurality of apertures therein.

9. An athletic swing practice apparatus in accordance with claim 5 in which said ring is a metal loop.

* * * * *